US007946890B1

(12) United States Patent
Bondo et al.

(10) Patent No.: US 7,946,890 B1
(45) Date of Patent: May 24, 2011

(54) ADAPTER FOR AN ELECTRONIC ASSEMBLY

(75) Inventors: Martin Bondo, Værløse (DK); Gerner Kurt Soelberg Pedersen, Lille Skensved (DK)

(73) Assignee: Sonion A/S, Roskilde (DK)

( * ) Notice: Subject to any disclaimer, the term of this patent is extended or adjusted under 35 U.S.C. 154(b) by 0 days.

(21) Appl. No.: 12/708,641

(22) Filed: Feb. 19, 2010

Related U.S. Application Data

(60) Provisional application No. 61/300,668, filed on Feb. 2, 2010.

(51) Int. Cl.
*H01R 25/00* (2006.01)
*H01R 27/02* (2006.01)
*H01R 31/00* (2006.01)

(52) U.S. Cl. ..... 439/638

(58) Field of Classification Search ..... 439/638
See application file for complete search history.

(56) References Cited

U.S. PATENT DOCUMENTS 5,404,407 A 4/1995 Weiss
5,796,821 A * 8/1998 Crouch et al. ..... 379/430

* cited by examiner

*Primary Examiner* — Javaid Nasri
(74) *Attorney, Agent, or Firm* — Nixon Peabody LLP

(57) ABSTRACT

An assembly having a first element that provides a signal that is received by a second element. The assembly includes a signal guide/transporter transporting the signal from the first to the second element and including a first and second connector/plug connected to the first and second elements, respectively. The assembly further includes an adapter for transmitting information to the first element and a third and fourth connector/plug. The third connector/plug is coupled to the first connector/plug to receive the signal, and the fourth connector/plug is coupled to the second connector/plug to transmit the signal received by the third connector/plug to the second connector/plug. The third and first connectors/plugs are adapted to forward the information transmitted by the adapter to the first element.

8 Claims, 3 Drawing Sheets

ADAPTER FOR AN ELECTRONIC ASSEMBLY

CROSS-REFERENCE TO RELATED APPLICATION

This application claims the benefit of U.S. Provisional Application Ser. No. 61/300,668, filed Feb. 2, 2010, entitled "An Adapter For An Electronic Assembly."

FIELD OF THE INVENTION

An aspect of the present invention relates to an adapter for use in an electronic assembly for communicating with an element of the assembly. The adapter is especially interesting in compact devices, as a plug or connector may be avoided for this communication.

SUMMARY OF THE INVENTION

This type of communication, here used in hearing aids, may be seen in U.S. Pat. No. 5,404,407, where a switch or the like is removed and the underlying connector used for communicating with electronics in order to program these electronics. However, removing the switch makes it impossible to use the hearing aid in normal operation.

In a first aspect, this disclosure relates to an assembly comprising:

a first and a second element, the first element comprising means for providing a signal, and the second element comprises means for receiving the signal, a signal guide/transporter adapted to transport the signal from the first element to the second element, the signal guide/transporter comprising a first and a second connector/plug each having first means for transporting the signal from the first connector/plug to the second connector/plug, the first and second connectors/plugs being adapted to disengageably engage so as to be able to transmit the signal, the first connector/plug being connected to the first element and the second connector/plug being connected to the second element, an adapter for transmitting information to the signal providing means, the adapter comprising a third and fourth connector/plug, the third connector/plug being adapted to disengageably engage the first connector/plug so as to receive the signal, the fourth connector/plug being adapted to disengageably engage the second connector/plug so as to transmit the signal received by the third connector/plug to the second connector/plug the third and first connectors/plugs additionally being adapted to forward the information to the signal providing means.

In the present context, a signal provider may output or provide an acoustic signal, an electrical signal and/or an optical signal. Thus, the signal guide/transporter may be adapted to guide/transport an acoustic signal, an electrical signal and/or an optical signal.

The first and second connectors/plugs are adapted to engage so as to transport the signal and to be disengaged. This disengagement may be one in which the first and second elements may then be separate elements, whereas they preferably are physically connected when the first and second connectors/plugs engage.

This engagement preferably is as that usual for plugs, where conductors (sound, electrical, power, radiation, or the like) engage so as to enable signals to flow from one connector/plug to the other. The engagement may be any type of engagement, such as a male/female plug type, a snap type engagement, a rotational and/or translational engagement or the like.

The signal receiving means may use the signal for any desired purpose, such as an outputting thereof in another shape or form, or the like. In one situation, the signal is an electrical signal, and the receiving means is a sound provider outputting a sound corresponding to the electrical signal. In another situation, the signal is an acoustical signal, and the receiving means may simply be an output for outputting the acoustical signal.

In other situations, the receiving means may alter a mode of operation based on the signal received and may even transmit signals back to the signal providing means or the first element if desired. Such signals may also be transmitted via the signal guide/transporter.

In order to be able to transport the signal from the signal providing means, the first and second connectors/plugs have first means for transporting the signal between the connectors/plugs. Such first means may be electrical conductors engaging when the first and second connector/plug engage, or corresponding sound channels or optical guides.

This may be standard plug or connector types having one or more conductors which, when the connectors/plugs engage, engage so as to allow transfer of the signals, of what ever type these are.

The information transmitted to the signal providing means may be used in the signal providing means in any desired manner.

The adapter has third and fourth connectors/plugs which are adapted to form breakable connections with the first and second connectors/plugs, respectively. Thus, when the first and third connectors/plugs engage, the signal is able to travel from the first element to the adapter, and when the fourth and second connectors/plugs engage, the signal is able to travel from the adapter to the second element. Thus, the third and fourth connectors/plugs have conductors suitable for engaging the conductors of the first and second connectors/plugs. Then, the signal may flow from the first element to the second element irrespectively of whether the adapter is used or not.

In addition, information may be transmitted from the adapter, such as from a circuit comprised in the adapter or connected thereto, to the signal providing means via the third and first connectors/plugs In one situation, the information may be transmitted to the signal providing means via the same conductor(s) as that/those used for transporting the signal. In this manner, the signal receiving means and the signal providing means and potentially the adapter (or a circuit providing the information) may be able to distinguish the signal from the information so that the normal operation of receiving the signal by the receiving means is not disturbed. In one situation, the signal may be a signal within a first frequency/amplitude/wavelength interval and the information may be transmitted within another interval outside of the first interval. Otherwise, a multiplexing, such as time division multiplexing, may be used.

Preferably, however, the first and third connectors/plugs comprise additional transporting means adapted to transport the information from the adapter to the signal providing means.

Thus, in this situation, the first and third connectors/plugs may have additional conductors (electrical/optical/acoustical or the like) which are used for transporting the information. In this embodiment, these additional transporting means or conductors are preferably positioned at other positions than those of the second and fourth connectors/plugs, as different functionalities may be obtained between transmitting the signal directly from the first to the second connector/plug and transmitting the signal from the first to the second connector/plug via the third and fourth connector/plug.

In a situation, the first and third connectors/plugs are identical or have the same number (and types if relevant) of conductors, as do the second and fourth connectors/plugs. In this situation part of the conductors may be used or useful for transporting the signal, and others may be used for or useful for transporting the information. Then, the adapter and the signal guide/transporter need not provide means for contacting or transporting signals to/from these other conductors.

In a simple embodiment, an electrical signal is output of the signal provider, and the information is transmitted as an electrical signal. Thus, the first, second, third and fourth connectors/plugs each has therein X conductors. The electrical signal is transported by Y conductors, $Y<X$, whereby the second and fourth connectors/plugs, even when being adapted to provide X connections, only use Y connections, and the remaining $X-Y$ connections are not used. Actually, no cables or the like need be connected to the remaining $X-Y$ conductors.

The adapter then transports the information using Z conductors, $Z+Y<X$, and the first and third connectors/plugs then each is adapted to transport the signal and information on these $Z+Y$ conductors. Thus, the signal guide/transporter has $Z+Y$ conductors between the first connector/plug to the signal providing means and Y conductors from the second connector/plug to the signal receiving means.

The adapter may then also have Z conductors which are connected to the Z conductors of the third connector/plug for transmitting the information to the first connector/plug. In this situation, the adapter may have Y conductors interconnecting conductors of the third and fourth connectors/plugs and Z conductors interconnecting the third connector/plug to either a circuit in the adapter or a fifth connector/plug of the adapter via which the adapter may receive the information from another circuit.

In a situation, the signal providing means is adapted to alter a mode of operation on the basis of information received. This mode of operation may be an altering of one or more characteristics of the signal output, such as a frequency, amplitude, or other characteristic.

It is noted that the present invention is especially suitable in miniature electronics, as the plugs and operation of the adapter makes possible the introduction of the information to the signal providing means without requiring a separate plug for this. In miniature electronics, such as hearing aids, plugs take up a lot of space and are avoided if possible.

In the situation of a hearing aid, the first part may be a part having e.g. electronics adapting an audio signal (electronic, sound, based on radiation or the like) to a hearing problem of a user. This signal may be output to a sound provider positioned in the first or the second elements.

However, the present first and second elements may be any other type of assembly. In one situation, the adapter further is adapted to derive the signal from the third connector/plug and forward this to another circuit, which may be that generating the information, so that the signal may be monitored or analyzed, and the information be generated on the basis of this analysis/monitoring in order to e.g. adapt the signal to predetermined criteria.

This may be relevant in the hearing aid situation but also in numerous other situations.

Another situation may be one where communication between two electronic components, such as a computer and a printer, an MP3-player and a docking station, or other wired connections. In this situation, the computer, printer, MP3-player or the like may be controlled or adapted on the basis of the communication on the cable, where the adapter now has been introduced between these elements, as it has the desired plugs/connectors and also has the possibility of providing the information and possibly deriving the signal.

Another aspect of this disclosure relates to a method of operating the assembly of the first aspect, wherein the signal providing means outputs a signal which is transported, via the first, second, third and fourth connectors/plugs and the signal guide/transporter to the receiving means, while, simultaneously, information is transmitted to the signal providing means via the first and third connectors/plugs, subsequent to which the signal providing means alters a mode of operation based on information received.

Thus, the normal operation of transmitting the signal to the signal receiving means is maintained while the information is transmitted to the signal generating means.

In this situation, simultaneously will mean that the signal may be transmitted at the same time as the information is fed to the signal providing means. Alternatively, the signal and information need not be fed at the same time, but signal transmission and information transmission are both possible without having to remove the adapter and re-connect the first and second connectors/plugs.

A third aspect of this disclosure relates to an assembly comprising a first element comprising a signal generator detachably connectable to a second element comprising a signal receiver, wherein the first element comprises a first connector member comprising a number of first signal guiding elements positioned in predetermined positions and being connected to the signal generator, the second element comprises second connector member having a number of second signal guiding elements being connected to the signal receiver and being adapted to detachably attach to the first connector member so that at least part of the first signal guiding elements engage at least part of the second signal guiding elements, the assembly further comprising an adapter having:

a third connector member having a number of third signal guiding elements and being adapted to detachably attach to the first connector member so that at least part of the first signal guiding elements engage at least part of the third signal guiding elements, a fourth connector member, having a number of fourth signal guiding elements and being adapted to detachably attach to the second connector member so that at least part of the fourth signal guiding elements engage at least part of the second signal guiding elements, one or more fifth signal guiding elements adapted to guide a signal from the at least part of the third signal guiding elements to the at least fourth signal guiding elements, a communication input/output adapted to receive and/or output a communication signal, and communication guiding elements adapted to guide the communication signal between the input/output and one or more of the third signal guiding means, wherein one or more of the first signal guiding elements are adapted to guide the communication signal to the signal generator.

Presently, the signal generator may be as the above signal provider, and the guiding elements may be adapted to guide any type of information, whether it be sound, radiation, electrical signals or the like.

The signal receiver may be an element converting the signal into e.g. sound or radiation or may simply receive and e.g. output the signal, if it was sound, radiation or the like.

Usually, when the two elements are attached to each other, guiding elements will engage. This attachment may be a clicking action, a rotary action, a bayonet action, a magnetic lock, a friction lock or the like. It is preferred that an attaching force is provided which prevents easy detachment of the two elements, but this is not required.

The engagement of the guiding elements may be a fixing of a first signal guiding element to a second signal guiding element, a mere abutment of the elements, a biasing of one element to the other or the like. If the elements are electrical conductors, an abutment or biasing may be desired, where it is less important where the conductors touch each other. If the guiding elements are sound or light guides, these need not touch, but the relative positions thereof is more critical in order to obtain a sufficient transfer of the sound/radiation from one guiding element to the other.

Usually, during attachment, pairs of a first and a second signal guiding elements engage/touch/transfer signal.

In a particular embodiment, the first and second elements form a male-female plug set. Where the male element is introduced into the female element along a predetermined direction. In this situation, in a cross section through the first and second elements perpendicularly to the direction of insertion, the first and second signal guiding elements may be positioned at least substantially at the same positions, which is primarily preferred, if sound or radiation is transmitted or if the engagement of electrical conductors is an abutment or biasing along the direction of introduction. However, the first and second signal guiding elements may also be positioned at different, but adjacent positions so that a biasing perpendicular to the direction of insertion is possible.

The adapter is adapted to be attached to the first and second elements and to relay a signal from the first element to the second element via the fifth signal guiding elements.

The above description of the function and positioning of the first and second elements and the signal guiding elements is also applicable when the adapter is used.

However, the adapter further has a communication input/output. This input/output may receive or output any type of signal, such as to/from an analyzing unit. Any signal input into or output by the communication input/output is communicated to/from the third connector member and the signal generator.

Thus, another signal output by the signal generator may be fed to the communication input/output, or a communication signal may be fed to the signal generator from the input/output.

In general, the signal output from the signal generator and fed to the signal receiver may be fed through all first and/or second signal guiding elements or only a part thereof. Usually, only the required number and type of signal guiding elements are provided, and it may be desired that a larger number of first signal guiding elements are provided, where part of the first elements are connected to the second elements, via the adapter or not, connected to the signal receiver and others are used for the communication signal.

Alternatively, the same first signal guiding elements may be used for both purposes, as is also described further above.

In the first situation, the first and third connector members may have more signal guiding elements (first and third guiding elements) than the second and fourth connector members. Then, in order to have inter-operability, the signal guiding elements used for guiding the signal from the signal generator to the signal receiver are provided in predetermined positions and the other signal guiding elements in other positions, so that the signal may be fed to the signal receiver via the adapter or not.

Preferably the signal generator is adapted to simultaneously output a signal for the signal receiver and receive a signal to and/or output a signal to the communication input/output.

A final aspect of this disclosure relates to an adapter for use in the above assemblies, the adapter comprising:

a first plug having first signal guides provided in or at first positions in a cross section along a predetermined plane of the first plug, a second plug having second signal guides provided in or at the first positions in a cross section along a predetermined plane of the second plug, connecting elements interconnecting the first signal guides with the second signal guides, a communication path comprising one or more third signal guides, wherein the second plug further comprises at least part of the third signal guides positioned in second positions in the predetermined plane of the second plug.

Usually, the connecting elements will be signal guides adapted to guide signals of the same type which the first and second signal guides are adapted to guide.

Preferably, the communication path has an input/output at which the third signal guides may be engaged or contacted from outside the adapter, such as via a plug or the like.

As is indicated above, the first and second plugs preferably are provided so as to be able to engage each other so that the first signal guides engage the second signal guides, preferably in pairs of a first and a second guide.

Preferably, the third signal guides are provided in the second plug at positions where these do not, during such attachment, engage the first signal guides.

In a situation, the first and second plugs form a male-female connection, where the cross sections may then be perpendicular to a direction of introduction of the male plug into the female plug.

BRIEF DESCRIPTION OF THE DRAWINGS

In the following, this disclosure will be described with reference to the drawing, wherein.

Figure 1:
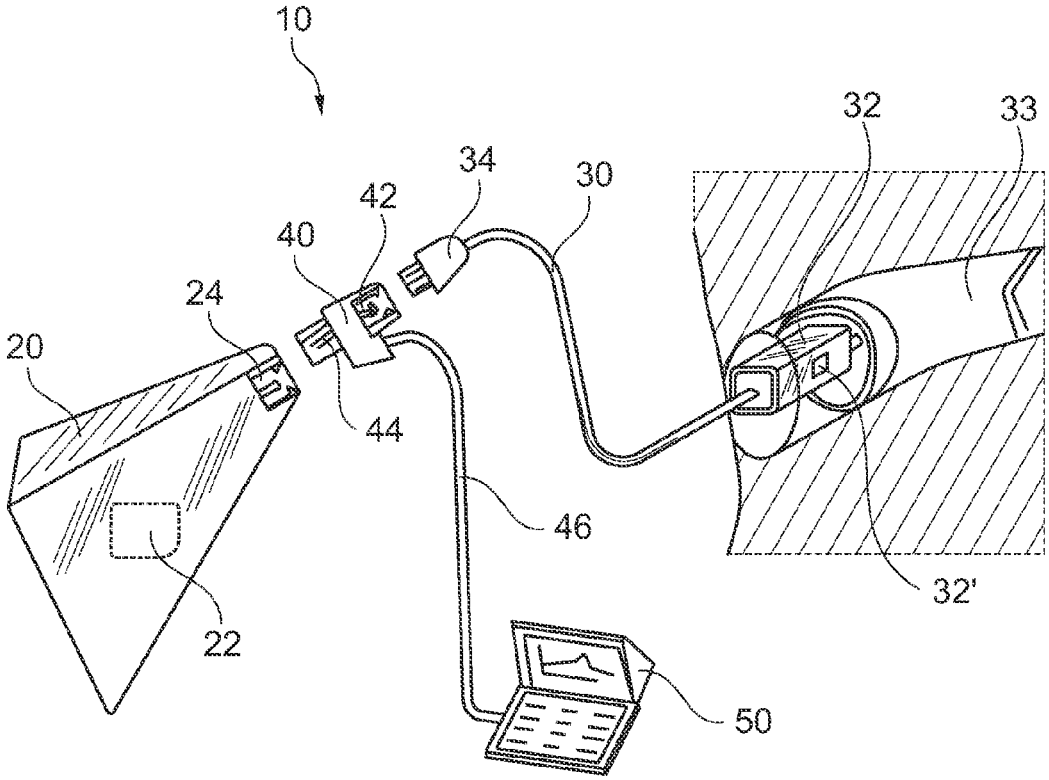
FIG. 1 illustrates a first embodiment according to an aspect of this disclosure.

While the aspects in this disclosure are susceptible to various modifications and alternative forms, specific embodiments thereof have been shown by way of example in the drawings and will herein be described in detail. It should be understood, however, that it is not intended to limit the disclosed aspects to the particular forms disclosed but, on the contrary, the intention is to cover all modifications, equivalents, and alternatives falling within the spirit and scope of the invention as defined by the appended claims.

DETAILED DESCRIPTION OF THE DRAWINGS

FIG. 1 illustrates an electrical assembly, here in the form of a hearing aid having a Behind-The-Ear (BTE) part 20 and an In-The-Ear part 32.

Usually, the BTE part 20 comprises a battery and electronics 22, such as an amplifier, for providing a signal, via a cable/signal guide/communication path 30, to the ITE part 32 which is positioned in the ear canal 33 of the person and provides the sound therein. The sound generator 32', usually called the receiver, may be provided in the ITE part 32, whereby the cable 30 will transport the electrical signals thereto, or in the BTE part 20, in which situation the cable 30 will be able to transport sound.

In many situations, the cable 30 may be detached from the BTE part 20 in order to be able to e.g. select different cable lengths. Thus, the cable 30 may have a plug or connector 34 adapted to engage a plug or connector 24 of the BTE part.

During normal operation, the electrical signals and/or acoustical signals (sound) are provided from the BTE part 20 to the ITE part 32 via the plugs 24 and 34 and the cable 30. Thus, the plugs 24 and 34 have the required, mating/contacting electrical connectors and/or sound conductors to facilitate this.

As the hearing reduction of different persons will differ, it is desired that the electronics 22 of the BTE part 20 may be adapted to the requirements of the individual person. Thus, the electronics 22 may be programmable or otherwise adaptable.

According to an aspect of this disclosure, an adapter 40 is used which has one plug 44 adapted to engage the plug 24 of the BTE part 20 and another plug 42 adapted to engage the plug 34 of the cable 30.

In order to be able to adapt the electronics 22 during normal operation of the hearing aid, the adapter 40 and the plugs 42 and 44 have the required electrical connectors and/or sound conductors to allow the hearing aid to provide the normal operation even though the adapter 40 is provided between the plugs 24 and 34.

In this respect, it is desired to alter the mode of operation of the electronics 22 while operating the hearing aid, i.e. to transmit sound to the ear of the user in order for her/him to give feedback as to e.g. the quality of the sound received.

The information provided to the electronics 22 may be used for altering a mode of operation of the electronics 22, such as to alter acoustical or electrical filters or an amplification of a signal, in order to alter characteristics of sound provided either in the BTE part 20, if the receiver is positioned in that part, or sound provided in the ITE part 32.

Using the present adapter 40, this adaptation may be performed while the hearing aid is in operation, and the user may immediately give feedback on the changes made.

In one situation, the plug 44 has at least the same electrical and/or sound conductors as the plug 34, and the plug 42 has at least the same electrical and/or sound conductors as the plug 24.

However, in order to program the electronics 22 via the adapter 40, such as using a test/adapting tool 50 communicating with the electronics 22 via a cable 46 and the adapter 40, the plugs 24 and 44 may actually have additional electrical conductors via which the electronics 22 and tool 50 communicate. In this situation, the plug 34 does not need corresponding connectors, as these are not required for normal operation and thus are not required by the ITE part 32. Then, it is ensured that the additional conductors of the plug 24 are positioned so as to not interfere with the connectors of the plug 34, when the plugs 24 and 34 engage. In one situation, the plugs 24, 34, 42 and 44 are really e.g. 8 pin plugs, but only 2-4 of the pins are used during normal operation, whereby only these are connected from the plug 34 to the ITE part 32, whereby the other 4-6 pins may be used for communication between the tool 50 and the electronics 22.

If the receiver is positioned in the BTE part 20, it may form part of the electronics 22, and sound is then to be provided between the BTE part 20 and the ITE part 32 via the cable 30 and the plugs 24, 34, 42, 44 which then have a sound channel. Then, the plugs 24 and 44 have additional signal conductors for the communication between the electronics 22 and the tool 50.

Alternatively, the conductors used during normal operation may be used also for the communication between the tool 50 and the electronics 22, if this can be done in a manner (frequency encoding in a frequency band outside that used by the receiver, for example) which does not interfere with normal operation. Then, the number of signal guiding elements in the plugs 24, 34, 42 and 44 may be the same.

Figure 2:
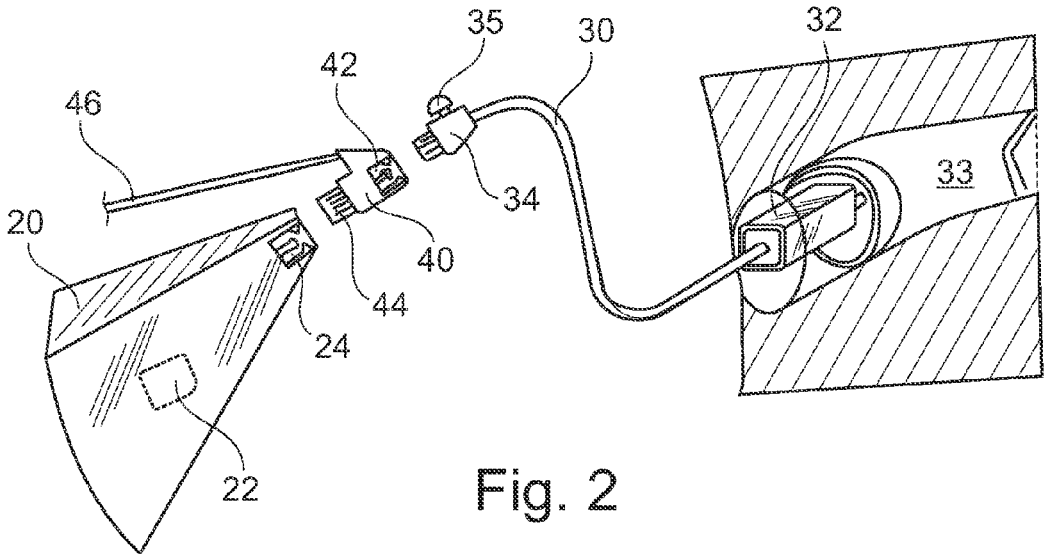
FIG. 2 illustrates a second embodiment according to another aspect of this disclosure.

In FIG. 2, all elements of FIG. 1, apart from the analyzer 50, are present. In addition, a pressure sensitive button 35 is provided on the plug 34, where it is easily accessible to the user. This button will, when operated, output a signal which may be fed, during operation, to the electronics 22 and may there be used to provide any result, such as a change in a mode of operation of the electronics 22. Then, the signal from the button 35 will also be fed via the plugs 24, 34, 42 and 44, whereby additional signal guides are desired, also within the adapter 40.

Different modes of operation may be operation based on sound received by a microphone, such as a microphone positioned in the BTE part 20 and connected to the electronics 22, or operation based on a tele coil also positioned in the BTE part 20 and connected to the electronics.

Alternatively, the button 35 may be used for altering other settings, such as of the electronics 22 or the receiver 32'. Such settings may be a volume or settings of sound or frequency contents, or the like.

Figure 3:
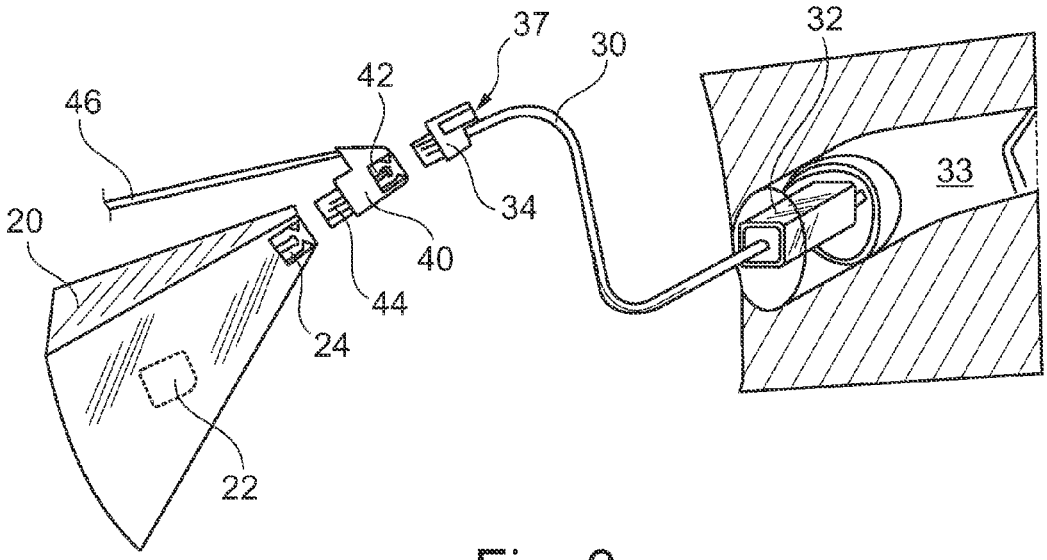
FIG. 3 illustrates a third embodiment according to a further aspect of this disclosure.

In FIG. 3, as in FIG. 2, most of the elements of FIG. 1 are present, but now a microphone 37 is provided in the plug 34. This position is desired, as it is normally positioned above the ear of the person and may therefore be directed toward the front of the person. This microphone may be connected to the electronics 22 and may be a main microphone for use in generating the sound signal to be processed by the electronics and then fed to the ITE part 32 either as an electrical signal or as sound. Alternatively, the microphone 37 may be an additional microphone to be used together with another microphone (not illustrated) positioned in another position of the BTE part 20 for providing the sound signal for the electronics 22.

Naturally, other elements may be provided at the plug 34, the cable 30 and/or the ITE part 32 for providing a signal for the electronics 22 —or the tool 50. One example is a microphone (not illustrated) positioned in the ITE part 32 and directed inwardly toward the ear drum in order to detect the sound output by the ITE part 32, such as a receiver 32'. In this manner, the sound detected by that microphone may be fed to the electronics 22 and/or the tool 50 for analysis.

FIGS. 4A-E illustrate different manners of providing a clicking action between pairs of plugs (24/44, 34/42 and/or 24/34) useful for ensuring sufficient engagement there between during operation. In general, as is also indicated in FIGS. 1-3, the plug pairs are illustrated as pairs of male-female plugs. Naturally, all types of plugs may be used.

Figure 4:
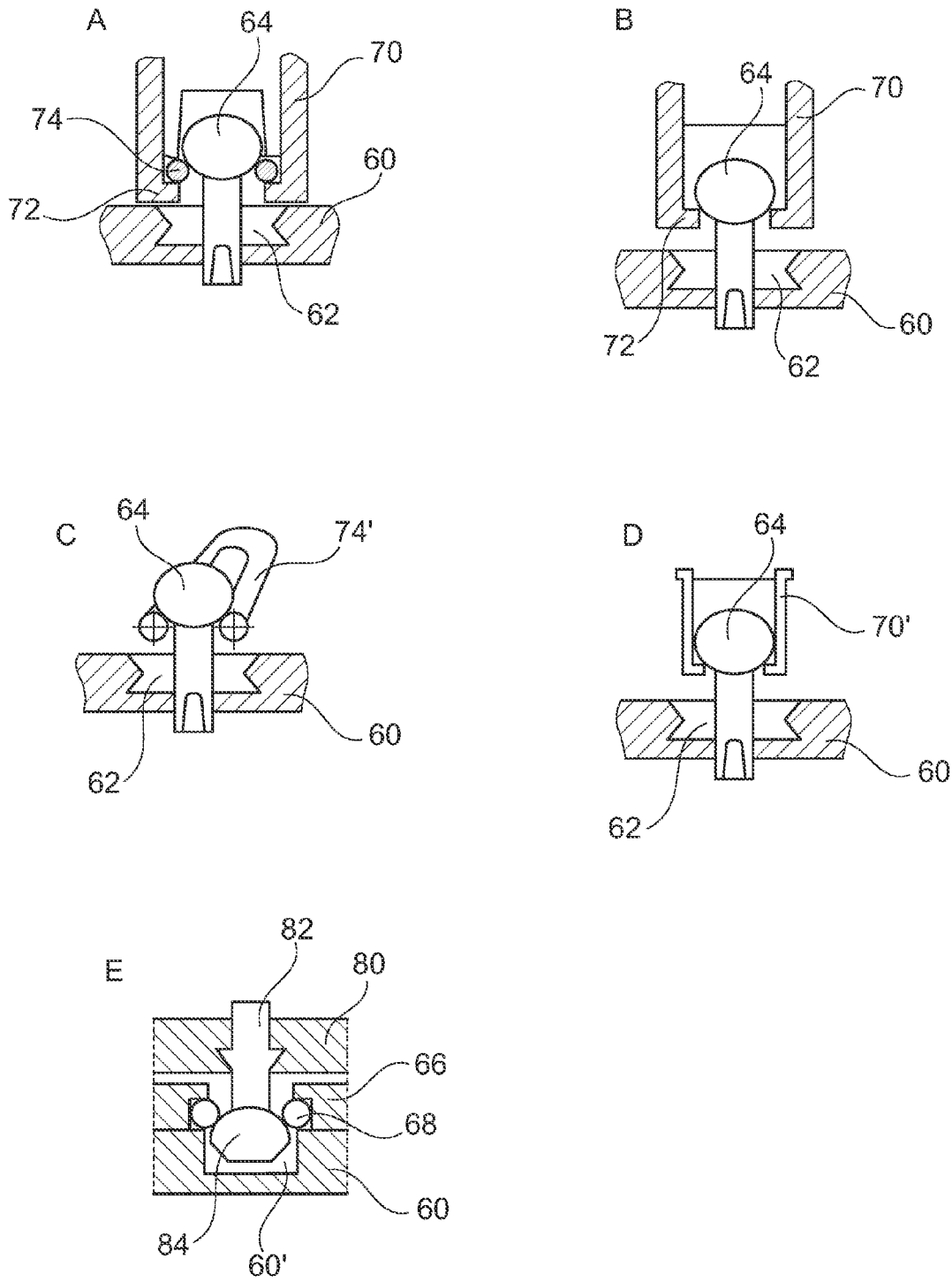
FIG. 4 illustrates different manners of providing a clicking action between a plug and a socket.

In FIG. 4A, the female plug is illustrated at the bottom with a base element 60 in which an insert 62 is provided having an upwardly extending part with a head portion 64. The male plug is provided at the top with a base part 70 extending into a cavity (not illustrated) of the female plug. The base part has inwardly extending parts 72 through which the head portion 64 extends and which support a narrowing part 74 which locks around a neck portion of the insert 62 and makes removal or retraction of the head portion 64 possible only with a force exceeding a predetermined force. The narrowing part 74 may be a rubber O-ring or the like.

In FIG. 4B, the locking action is provided by the inwardly extending parts 72.

In FIG. 4C, the locking is provided by a U-shaped element 74', which may be attached to the base part 70, which is not illustrated in this figure. This U-shaped element 74' may be a metal element, a plastic element or another element which by proper selection of material and dimensions gives the desired fixing force.

In FIG. 4D, the base part 70' may be made of a stronger material, compared to FIG. 4B, and may thus be made thinner. Again, selection of the material properties and the dimensions will define the fixing force and the force required for detachment.

FIG. 4E is of an inverted structure in which a cavity 60' is provided in a base element 60 of the female part. The male part has a base element 80 in which an extending element 82 is provided having a head portion 84 extending into the cavity 60' and being locked therein by a narrowing element 68, such as an O-ring, which is kept in place by narrowing parts 66. Again, the material properties and dimensions of the narrowing element 68 will define the fixing and detachment forces.

Naturally, the above electrical conductors may be fully or partly replaced by light guides, depending on the situation, such as the amount of information transported etc.

Also, the above situation may be reversed so that the element communicating with the tool 50 is in the ITE part 32, whereby any additional conductors are present in the plugs 34 and 42.

The aspects of the above disclosure have been described in relation to a hearing aid, as a main advantage of aspects of this disclosure is that a separate programming plug is avoided in the BTE part 20 which is especially desirable in relation to miniaturized devices, such as hearing aids.

However, other reasons may exist for wishing to avoid additional plugs, such as aesthetic reasons.

Thus, aspects of this disclosure are useful in any assemblies of elements interconnected by plugs or contacting elements, and where communication to one of the elements is desired while it is connected to the other element.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. An assembly comprising:

a first and a second element, the first element comprising means for providing a signal, and the second element comprises means for receiving the signal, a signal guide/transporter adapted to transport the signal from the first element to the second element, the signal guide/transporter comprising a first and a second connector/plug each having first means for transporting the signal from the first connector/plug to the second connector/plug, the first and second connectors/plugs being adapted to disengageably engage so as to be able to transmit the signal, the first connector/plug being connected to the first element and the second connector/plug being connected to the second element, an adapter for transmitting information to the signal providing means, the adapter comprising a third and fourth connector/plug, the third connector/plug being adapted to disengageably engage the first connector/plug so as to receive the signal, the fourth connector/plug being adapted to disengageably engage the second connector/plug so as to transmit the signal received by the third connector/plug to the second connector/plug, the third and first connectors/plugs additionally being adapted to forward the information to the signal providing means, wherein the first and third connectors/plugs comprise additional conductors relative to the second and fourth connectors/plugs, the conductors being adapted to transport the information from the adapter to the signal providing means.

2. An assembly according to claim 1, wherein the signal providing means is adapted to alter a mode of operation on the basis of information received.

3. A method of operating the assembly of claim 1, wherein the signal providing means outputs a signal which is transported, via the first, second, third and fourth connectors/plugs and the signal guide/transporter to the receiving means, while, simultaneously, information is transmitted to the signal providing means via the first and third connectors/plugs, subsequent to which the signal providing means alters a mode of operation based on information received.

4. The assembly according to claim 1, wherein:

the first connector/plug has first signal guides provided in or at first positions in a cross section along a predetermined plane of the first connector/plug, the second connector/plug has second signal guides provided in or at the first positions in a cross section along a predetermined plane of the second connector/plug, the assembly further comprising connecting elements interconnecting the first signal guides with the second signal guides, and a communication path comprising one or more third signal guides, wherein the first plug further comprises at least part of the third signal guides positioned in second positions in the predetermined plane of the first connector/plug.

5. The assembly according to claim 1, wherein the conductors include electrical conductors, optical conductors, or acoustical conductors.

6. An assembly comprising a first element comprising a signal generator detachably connectable to a second element comprising a signal receiver, wherein the first element comprises a first connector member comprising a number of first signal guiding elements positioned in predetermined positions and being connected to the signal generator, the second element comprises a second connector member having a number of second signal guiding elements being connected to the signal receiver and being adapted to detachably attach to the first connector member so that at least part of the first signal guiding elements engage at least part of the second signal guiding elements, the assembly further comprising an adapter having:

a third connector member having a number of third signal guiding elements and being adapted to detachably attach to the first connector member so that at least part of the first signal guiding elements engage at least part of the third signal guiding elements, a fourth connector member, having a number of fourth signal guiding elements and being adapted to detachably attach to the second connector member so that at least part of the fourth signal guiding elements engage at least part of the second signal guiding elements, one or more fifth signal guiding elements adapted to guide a signal from the at least part of the third signal guiding elements to the at least part of the fourth signal guiding elements, a communication input/output adapted to receive and/or output a communication signal, and communication guiding elements adapted to guide the communication signal between the input/output and one or more of the third signal guiding elements, wherein one or more of the first signal guiding elements are adapted to guide the communication signal to the signal generator, and wherein the number of first signal guiding elements is larger than the number of second signal guiding elements.

7. The assembly according to claim 6, wherein:

the first connector member has first signal guides provided in or at first positions in a cross section along a predetermined plane of the first connector member, the second connector member has second signal guides provided in or at the first positions in a cross section along a predetermined plane of the second connector member, the assembly further comprising connecting elements interconnecting the first signal guides with the second signal guides, and a communication path comprising one or more third signal guides, wherein the first connector member further comprises at least part of the third signal guides positioned in second positions in the predetermined plane of the first connector member.

8. The assembly according to claim 6, wherein the first signal guiding elements include electrical conductors, optical conductors, or acoustical conductors.

* * * * *